United States Patent [19]

Nelson

[11] 4,141,153

[45] Feb. 27, 1979

[54] BOTTOM HOLE SURVEY APPARATUS

[75] Inventor: Paul M. Nelson, Houston, Tex.

[73] Assignee: Wilson Industries, Inc., Houston, Tex.

[21] Appl. No.: 821,461

[22] Filed: Aug. 3, 1977

[51] Int. Cl.[2] ..... G01B 5/24; E21B 47/022

[52] U.S. Cl. ..... 33/286; 33/302; 33/304; 175/44; 175/61; 403/359

[58] Field of Search ..... 33/286, 304, 301, 302, 33/1 R, 1 H; 403/359; 175/44, 40, 61; 74/64

[56] References Cited

U.S. PATENT DOCUMENTS

| | | | |
|---|---|---|---|
| 2,088,539 | 7/1937 | Stokenbury | 33/286 X |
| 2,735,652 | 2/1956 | Brady | 175/44 |
| 3,052,309 | 9/1962 | Eastman | 175/61 X |
| 3,726,546 | 4/1973 | Brown | 403/359 X |
| 3,938,398 | 2/1976 | Bloom et al. | 403/359 |

*Primary Examiner*—William D. Martin, Jr.
*Attorney, Agent, or Firm*—Arnold, White & Durkee

[57] ABSTRACT

A bottom hole survey apparatus is characterized by a survey instrument having a reference line therein, the instrument being receivable by the engagement of flanges provided along the instrument into keyways provided on the interior of a non-magnetic instrument barrel. When engaged, the reference line of the survey instrument is disposed in a predetermined angular relation with respect to the barrel. The barrel has means provided on the exterior thereof for receiving a visual sighting element thereon, the sighting element being in a predetermined angular relationship with respect to the reference line. At least one non-magnetic spacer element is connectable to the barrel, the spacer element being provided with an adapter having a T-shaped head thereon which is received within a corresponding T-shaped groove provided at the lower end of the instrument. A mule shoe element having a slot therein is adjustably connectable to the lower end of the spacer, the mule shoe slot being adapted to receive a second visual sighting element such that when the sighting elements are aligned the reference line within the instrument is within a predetermined axial alignment with the mule shoe slot. A torque transmitting sub element including a plurality of axially spaced arrays of circumferentially disposed ridges engageable with an array of circumferentially disposed grooves may be connected between the spacer and the mule shoe.

8 Claims, 18 Drawing Figures

FIG.1F
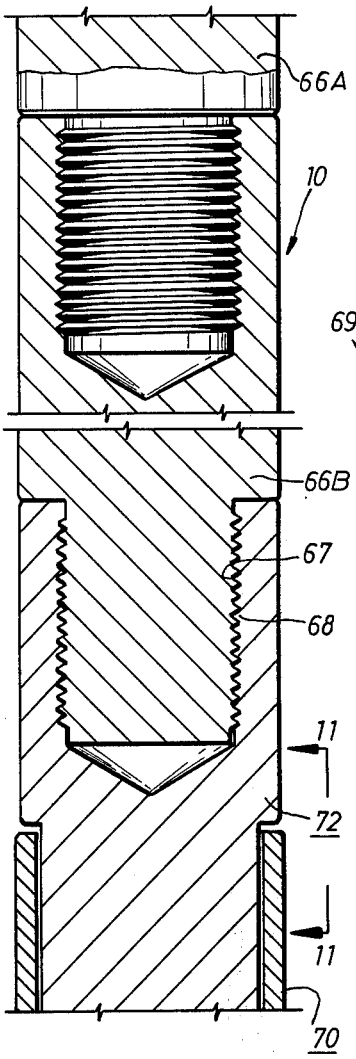
FIG.1G
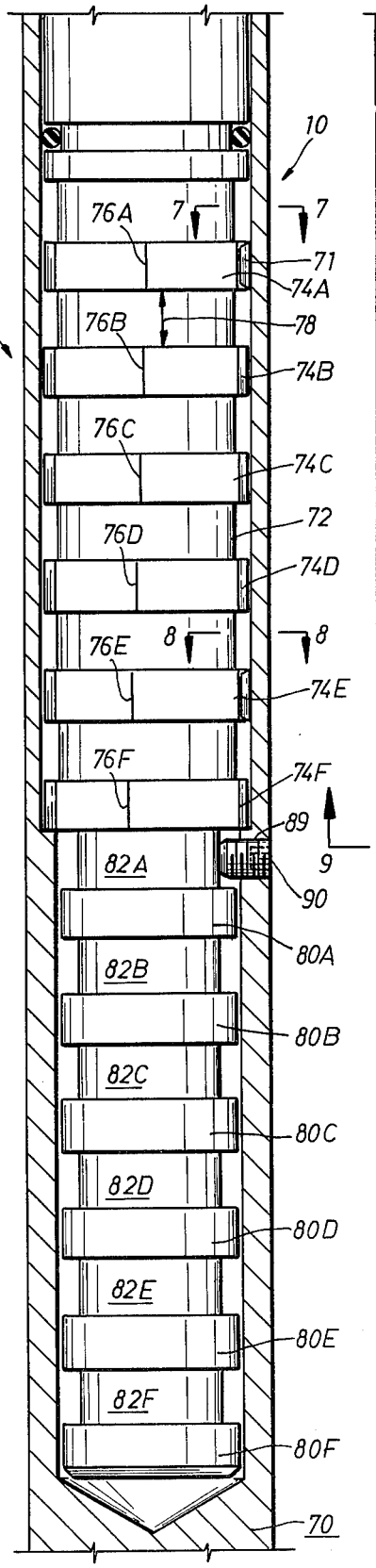
FIG.1H
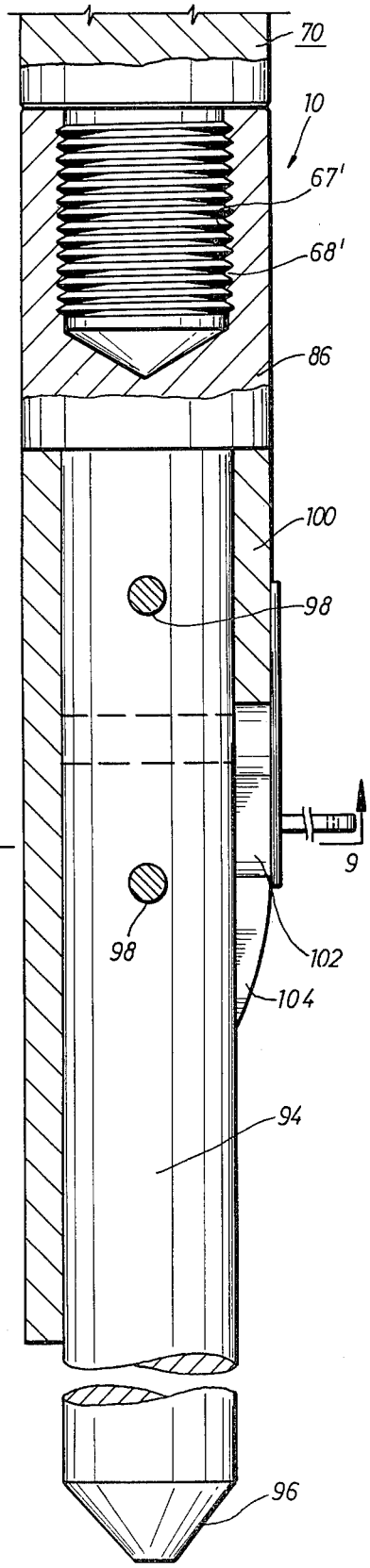
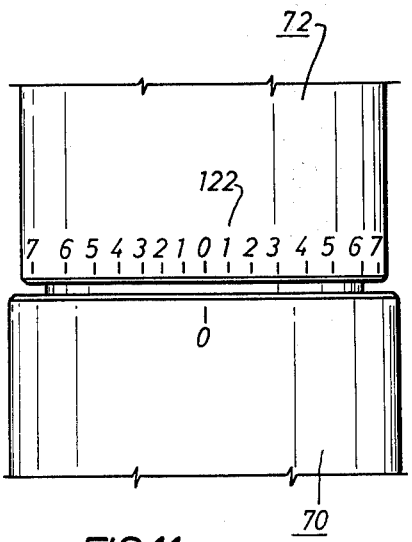
FIG.11

FIG. 5
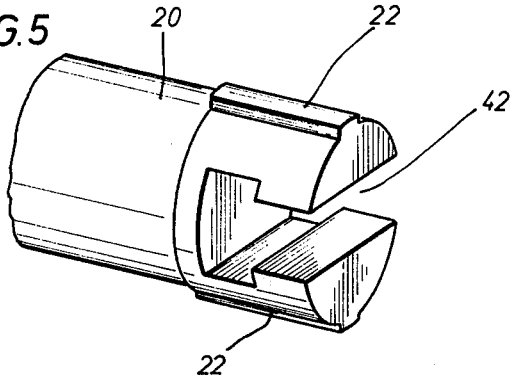
FIG. 6
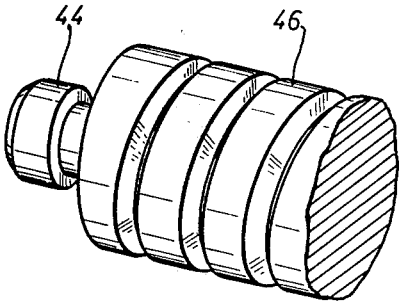
FIG. 4
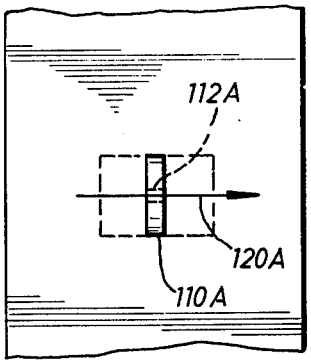
FIG. 10
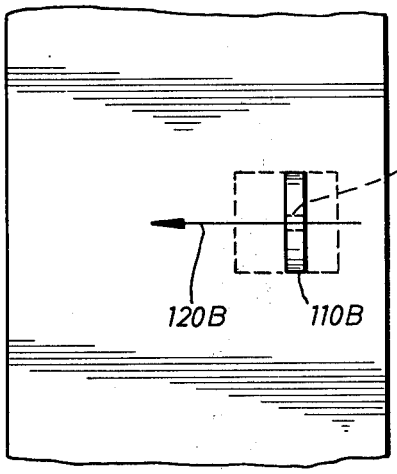
FIG. 9
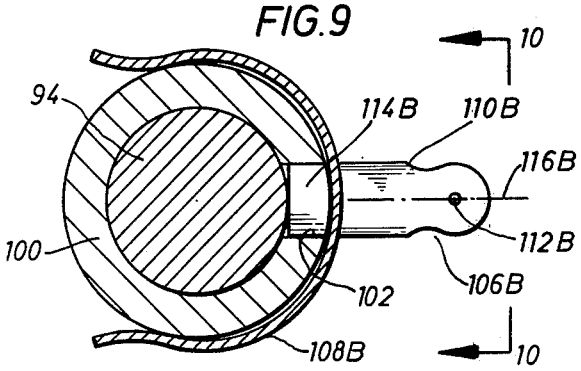
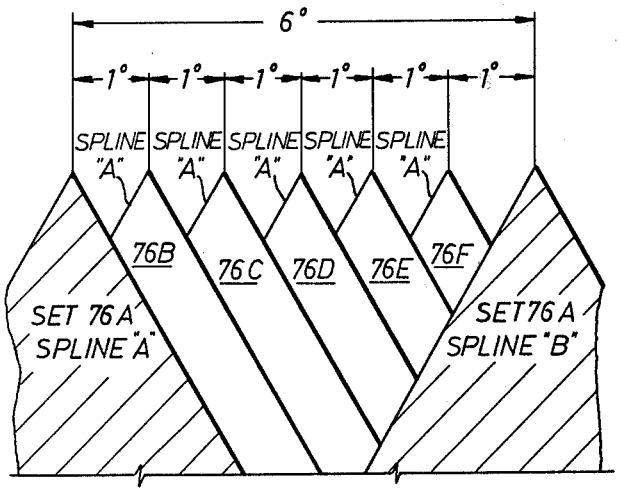
FIG. 7
FIG. 8
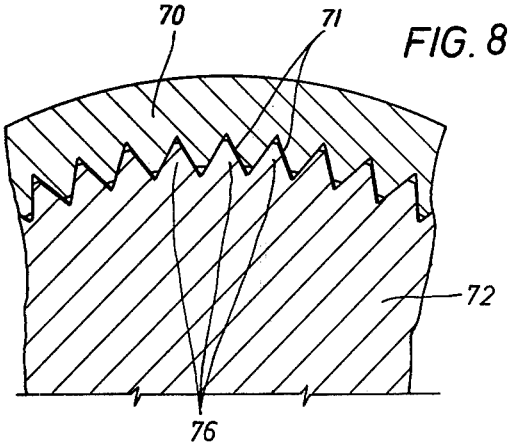

BOTTOM HOLE SURVEY APPARATUS

BACKGROUND OF THE INVENTION

1. Field of the Invention

This invention relates to downhole well tools and, in particular, to a survey apparatus adopted to ascertain the angular orientation of a drilling tool with respect to a predetermined datum.

2. Description of the Prior Art

In directional drilling work it is often desirable to ascertain the direction in which a deflectable drilling element is oriented with respect to a predetermined datum. It is only by ascertaining this orientation that drilling operators on the surface can accurately determine if the directional drilling procedure is being effectuated in accordance with a predetermined drilling plan. To this end there is usually provided in a predetermined axial alignment with the deflectable drilling element a key member projecting radially inwardly into the interior of the drill string of which the deflectable drilling element is the lowermost constituent element.

To periodically ascertain the orientation of the deflectable drilling element it is necessary to lower into the interior of the drill string a suitable bottom hole directional survey apparatus. The survey apparatus generally includes a survey instrument of a standard type, typically comprising a magnetic compass, a transparent glass ring having a plurality of concentric circles scribed thereon, as well as a radially extending reference indicator line, a camera and a light source. The lowermost constituent element of the survey apparatus is usually a mule shoe element. The reference line within the instrument is angularly aligned with an axially extending slot provided in the mule shoe element.

Since the reference line in the survey instrument is angularly aligned with the slot in the mule shoe, when the survey apparatus is lowered or pumped down into the interior of the drill string, engagement of the key with the slot in the mule shoe guarantees axial alignment between the reference indicator line in the instrument, the slot in the mule shoe, the key engaged therewith, and the deflectable drilling element having the key. In this manner, an accurate indication of the magnitude of the deviation (if any) between a predetermined angular datum and the actual orientation of the deflectable drilling element may be obtained.

It is, therefore, of utmost importance that prior to the lowering or pumping down of the survey apparatus accurate axial alignment be established between the slot in the mule shoe and the reference line scribed within the instrument. Prior art, such as U.S. Pat. No. 3,052,309 (Eastman), provides for the orientation and alignment of the reference line in the instrument with the slot in the mule shoe by the utilization of liquid leveling clamps. Further, the last-mentioned Eastman patent describes means for adjustably orienting the mule shoe with the reference line to permit any predetermined number of axially elongated, non-magnetic, spacer elements to be threaded into the bottom hole survey apparatus between the instrument and the mule shoe. This adjustable arrangement includes a lock nut disposed upon an orienting lug to permit threaded adjustment of the angular orientation of the lug with respect to the survey apparatus. The lug exhibits a predetermined shape adapted to be received in a keyway provided in the lower end of the instrument. It is appreciated that by the provision of such an adjustable locking arrangement using an orienting lug assembly in cooperation with a threaded locking nut the reference line in the instrument may be aligned axially and angularly with the slot in the mule shoe, even if a variable number of non-magnetic spacer elements are interposed therebetween. However, it is also appreciated that it is necessary to disassemble the survey apparatus to gain access to the adjustment arrangement each time it is decided to shorten or elongate the apparatus by the addition or removal of spacers. Of course, the spacers are required to define a non-magnetic portion of the survey apparatus sufficient to permit the magnetic compass disposed within the instrument to function reliably.

U.S. Pat. No. 2,956,781 (Eastman) defines a prior art deflecting tool, the orientation of which a survey apparatus is utilized to ascertain. U.S. Pat. No. 2,819,039 (Lindsay) and U.S. Pat. No. 2,819,040 (James) further illustrate deflecting tools known in prior art. U.S. Pat. No. 3,122,213 (Hawk) discloses an apparatus for orienting a tool in a well bore.

U.S. Pat. No. 2,088,539 (Stokenbury) relates to a method and apparatus for orienting a deflecting tool within a well bore by the utilization of axially spaced peep sights. U.S. Pat. No. 2,207,505 (Bremner) and U.S. Pat. No. 2,246,417 (Smith) relate to drill pipe orienting tools. Bremner generally discloses the utilization of scribe lines on adjacent tool elements such that threaded engagement therebetween disposes the scribe lines in next-axial alignment to insure the proper axial relationship between the next-adjacent elements. It is noted that the apparatus shown in Bremner is unable to be utilized if the scribed elements are axially spaced, as by a plurality of spacers, one from the other. Smith discloses a threadedly adjustable orienting tool whereby axial alignment between members may be adjusted by threaded rotation of one member with respect to another. Although Smith provides as an advantage the adjustability of the members by an externally accessible threaded engagement therebetween, no locking arrangement other than the frictional fit of engaged threads is disclosed, taught or suggested.

U.S. Pat. No. 1,815,319 (McCoy) relates to a method for diverting a well drilling tool. U.S. Pat. No. 2,318,590 (Boynton) discloses threaded lock arrangement utilizing a plurality of circumferentially disposed splines. Other patents relating to the orientation of a bore hole device include U.S. Pat. No. 3,718,194 (Hering), U.S. Pat. No. 3,175,608 (Wilson, relating to directional tubing perforation), U.S. Pat. No. 3,363,703 (Shewmake, relating to a coring tool), U.S. Pat. No. 3,450,216 (Hugel, relating to a core orienting apparatus) and U.S. Pat. No. 2,207,507 (Douglas, relating to a telltale). Other patents relating generally to the orientation of a bore hole include U.S. Pat. Nos. 3,633,280 and 3,711,118 (both to Lichte). U.S. Pat. Nos. 3,215,204 (Sims) and 3,339,636 (Frisby) both relate to a whipstock. U.S. Pat. Nos. 3,068,946 and 3,156,310 (both to Frisby) relates to knuckle joints.

It would be advantageous to provide a survey apparatus whereby alignment between a reference indicator line disposed within the survey instrument may be aligned with an axially extending slot provided in a mule shoe element in an expeditious and accurate manner after the assembly and connection of the survey tool is completed. It would be of further advantage to be able to provide such alignment without the necessity of disassembling the apparatus to gain access to a locking arrangement which utilizes a lug receivable within a keyway in the instrument itself. Furthermore, it would be advantageous to provide an externally accessible adjusting arrangement to facilitate the alignment of a reference line and a slot in the mule shoe whenever spacers are added or withdrawn from the survey apparatus. It would be also advantageous to utilize visual means, such as sights or the like, the expeditiously orient the members in order to insure alignment between the reference line in the instrument and the slot in the mule shoe.

It would also be of advantage to provide a bottom hole survey apparatus having a torque transmitting sub therein utilizing a predetermined plurality of axially spaced sets of splines, each set containing a predetermined number of splines with corresponding splines in each set being angularly offset such that any predetermined one of the sets of splines may be selectively engaged with an array of grooves disposed on the interior of a member so that the reference line may be oriented with the slot in the mule shoe within a predetermined tolerance and yet be securely affixed in a torque-transmitting relationship.

SUMMARY OF THE INVENTION

A bottom hole survey apparatus embodying the teachings of this invention is characterized by a instrument having a reference line therein and axially extending flanges disposed on the exterior thereof. The flanges are adapted to be received within keyways provided on the interior of an instrument housing, or barrel, such that when the flanges and keyways are engaged the reference line is disposed in a predetermined angular relationship with respect to the barrel. The barrel also disposes on the exterior thereof means for receiving a visual sighting element. When the visual sighting element is received within the means provided on the exterior of the barrel, an axis through the visual sighting element is coincident with the radial extension of the reference line disposed within the instrument.

The lower axial end of the instrument has a substantially T-shaped groove therein adapted to receive a correspondingly shaped T-head provided on an adapter element connected to a non-magnetic spacer. With the T members on the adapter and instrument engaged, means are provided for connecting the instrument barrel with the spacer. The lower end of the spacer adjustably receives a mule shoe element having an axially extending slot therein. The slot of the mule shoe is adapted to receive a second visual sighting element such that when alignment is obtained between the visual sighting elements the slot in the mule shoe is disposed in a predetermined known angular relationship with respect to the reference line in the instrument. Locking means for maintaining the mule shoe in the desired aligned relationship with the instrument are provided.

A torque transmitting element may be advantageously disposed at the lower end of the spacer for engagement with the mule shoe element. The torque transmitting sub comprises a first member having a predetermined plurality of axially extending grooves disposed thereon and a second member having a plurality of arrays of circumferentially spaced ridges. Each array has a predetermined plurality of ridges, with each ridge in each array being displaced from the next-adjacent ridge a first predetermined angular distance. Further, each ridge in each array is angularly offset a second predetermined angular distance from a corresponding point on the corresponding ridge in the next-axially adjacent array. The second angular distance is less than the first angular distance. The arrays of ridges are provided such that the number of ridges in each array multiplied by the number of arrays is equal to 360. Thus, the angular deviation between a selected angular location and a location wherein one of the array of ridges registers with the grooves is a maximum of a half degree.

A graduated scale may advantageously be provided on the exterior of the mule shoe and its next-adjacent spacer element so that the mule shoe may be oriented to accomodate local deviations between magnetic north and true north prior to the insertion of the survey apparatus embodying the teachings of this invention within a well bore.

BRIEF DESCRIPTION OF THE DRAWINGS

The invention will be more fully understood from the following detailed description thereof, taken in connection with the accompanying drawings, which form a part of this specification, and in which:

FIGS. 1A through 1H are elevational views, substantially entirely in section, illustrating a bottom hole survey apparatus embodying the teachings of this invention;

FIG. 4 is a partially developed view of the portion of the survey apparatus having the sight mounted thereon taken substantially along lines 4—4 in FIG. 3;

FIG. 5 is an isolated perspective view taken substantially along lines 5—5 of FIG. 1 illustrating the lower axial end of an instrument utilized in connection with a survey apparatus embodying the teachings of this invention;

FIG. 6 is an isolated perspective view of the upper axial end of a retainer and adapter assembly utilized in connection with a survey apparatus embodying the teachings of this invention taken substantially along lines 2—2 in FIG. 1;

FIG. 7 is a view taken along lines 7—7 in FIG. 1 showing the relationship between corresponding splines in axially spaced sets of splines disposed in accordance with the teachings of this invention;

FIG. 8 is an enlarged section view taken along section lines 8—8 of FIG. 1 showing the mated interconnection between splines in one of the predetermined number of arrays of splines provided on a first member and the corresponding grooves provided on the interior of a second member to define a torque transmitting element in accordance with the teachings of this invention;

FIG. 9 is a sectional view taken substantially along section lines 9—9 in FIG. 1;

FIG. 10 is a partially developed view of the mule shoe element of the survey apparatus taken along lines 10—10 in FIG. 9; and, FIG. 11 is a view taken along lines 11—11 in FIG. 1F.

DESCRIPTION OF PREFERRED EMBODIMENT

Figure 1A:
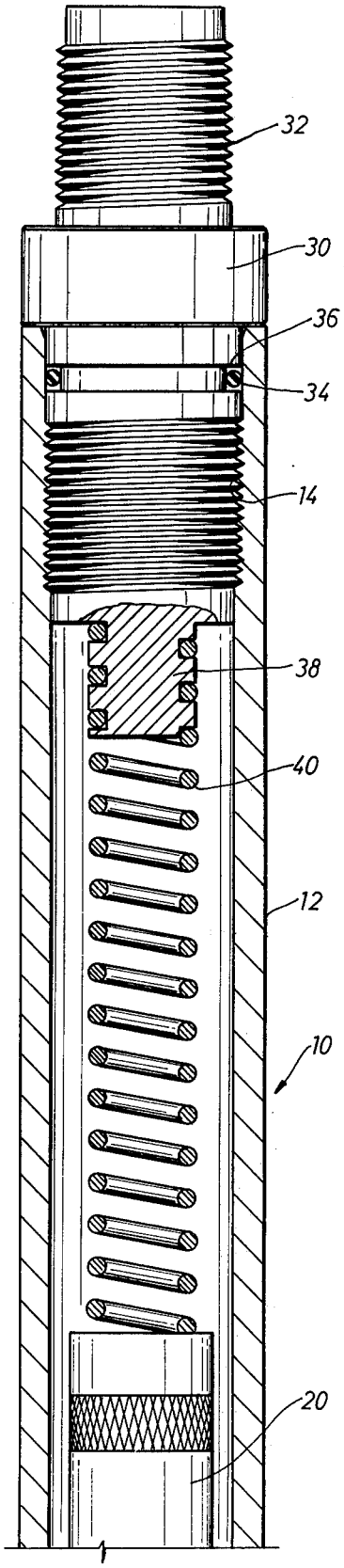
Figure 1B:
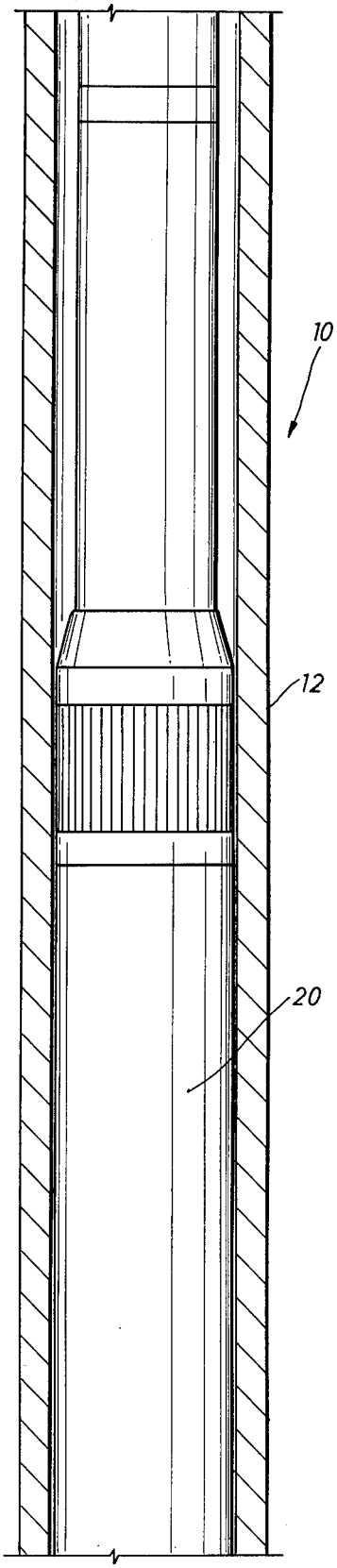
Figure 1C:
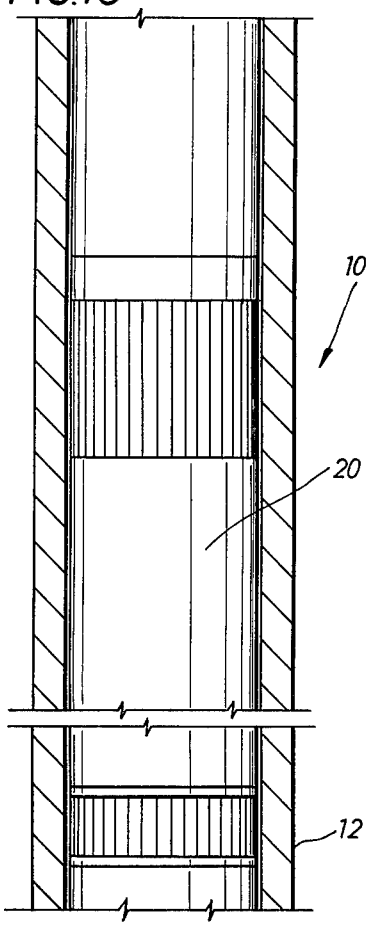

Throughout the following description similar reference numerals refer to similar elements in all figures of the drawings.

Figure 2:
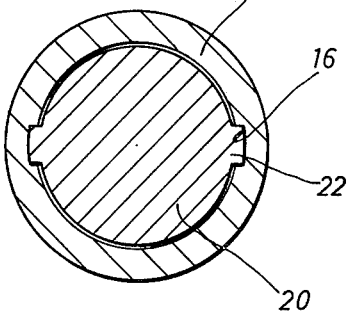
FIG. 2 is a sectional view taken along section lines 2—2 of FIG. 1.

Referring to FIGS. 1A through 1H, elevational views substantially entirely in section of a bottom hole survey apparatus generally indicated by reference numeral 10 are shown. The survey apparatus 10 includes a substantially tubular instrument housing, or barrel, 12 which is provided with internal threads 14 at the upper axial end thereof. The barrel 12 is preferable fabricated of a non-magnetic material, as K-monel or stainless steel. Adjacent the lower axial end of the barrel 12 are axially extending grooves 16 provided above a plurality of screw threads 18 disposed on the interior of the barrel 12. The barrel 12 is adapted to receive therewithin a bottom hole survey instrument 20 having an elongated tubular configuration. The instrument 20 is provided with axially extending flanges 22 along a predetermined portion of its length. The flanges 22 are receivable within the axially extending grooves 16 provided on the interior of the barrel 12, as best illustrated in FIG. 2. In this manner, the instrument 20 is prevented from rotation with respect to the interior of the barrel 12, in a manner conventional in the art.

Figure 3:
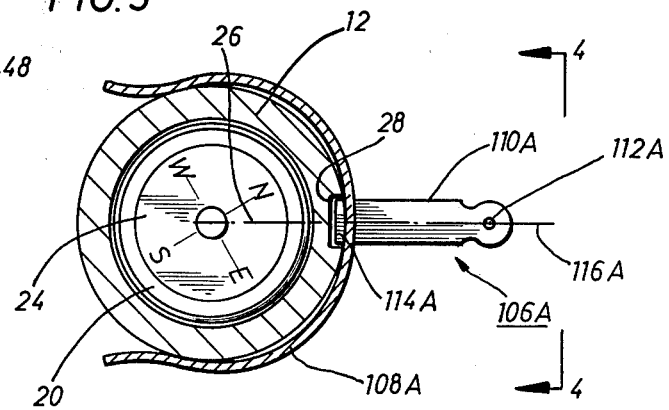
FIG. 3 is a view, partly in section, taken along lines 3—3 of FIG. 1 illustrating an end view of a snap-on sight utilized in connection with a survey apparatus embodying the teachings of this invention.

The instrument 20 may conveniently contain a camera, a magnetic compass, and other suitable elements whereby a permanent record of the orientation of a member, such as a deflectable drilling element or the like, may be provided. The instrument 20 includes a planar surface 24 (FIG. 3) having thereon a substantially radially extending (with reference to the barrel 12) reference indicator line 26. With the instrument 20 engaged by its flanges 22 to the grooves 16 provided on the interior of the instrument barrel 12, it is understood that the radially disposed indicator line 26 is in a fixed position with respect to the barrel 12. It is, however, of utmost importance that the indicator line 26 be also disposed in a predetermined known relationship with respect to a mule shoe member provided on the lower axial end of the bottom hole survey apparatus 10. It is an object of this invention to provide an apparatus whereby the mule shoe and the indicator line 26 may be brought into a predetermined known angular alignment despite the axial spacing of these elements one from the other prior to the insertion of the bottom hole survey apparatus 10 into a bore extending through a running string or drill string.

Figure 1D:
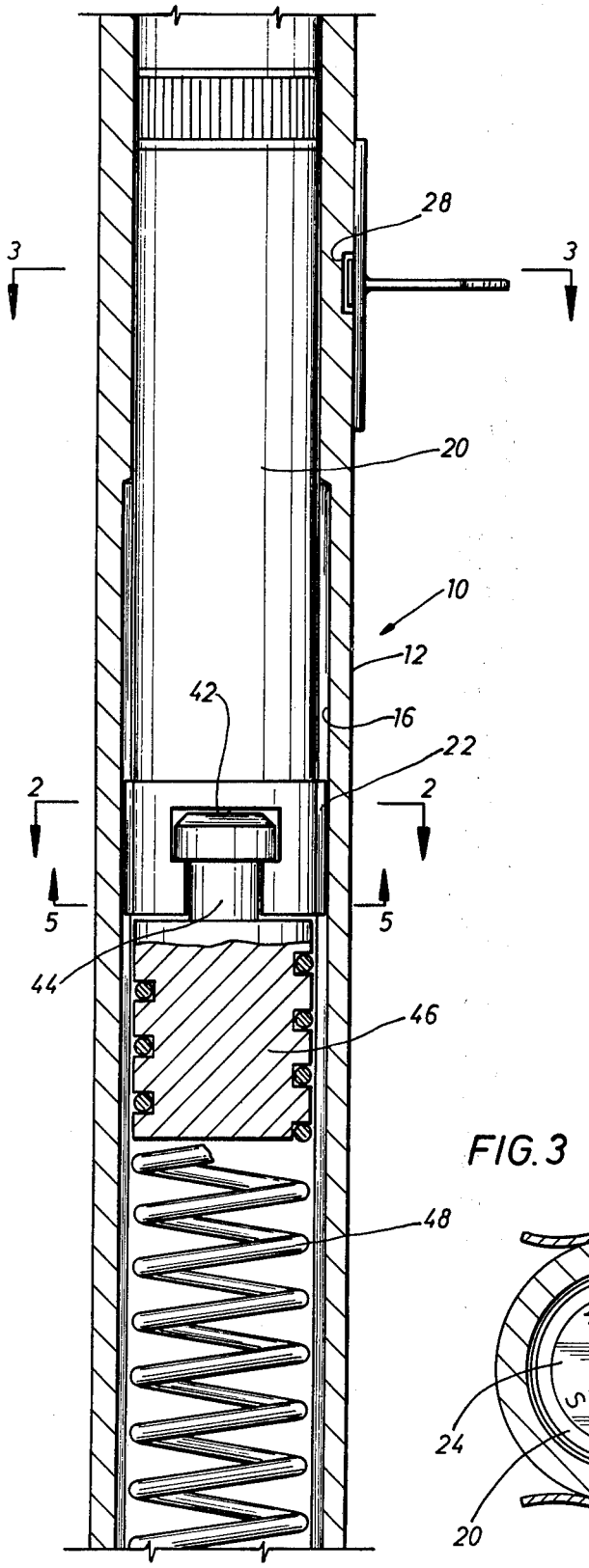

In furtherance of this aforementioned purpose, the exterior of the instrument barrel 12 is provided with an alignment keyway 28 (FIG. 1D). The alignment keyway 28 may be provided at any circumferential location on the exterior of the barrel 12, but it is preferably located thereon such that an extension of the radially disposed indicator reference line 26 bisects the alignment keyway 28. The purpose for such an arrangement is made more clear herein.

The internal thread 14 disposed at the upper end of the instrument barrel 12 may be threadedly connected to a suitable sub element 30 itself having externally disposed threads 32 thereon. The integrity of the threaded connection is maintained in a leak-proof manner by the provision of an O-ring 34 disposed in a groove 36 circumferentially disposed about the exterior surface of the sub 30. The sub 30 may itself be connected to a predetermined number of non-magnetic spacer elements (not shown) which, in their turn, may be connected to a wire line or other suitable apparatus whereby the bottom hole survey apparatus 10 is lowered into the internal bore through the drill string. In the alternative, the bottom hole survey apparatus 10 may be pumped-down the interior of the drill string, in which event the upper axial end of the sub 32 may be connected directly or indirectly (again through spacer elements) to a rope socket to permit retrieval of the apparatus 10. The spacers are usually provided of a non-magnetic material, such as aluminum, in order to avoid aberrations in the instrument readings generated by proximity of the instrument to metallic elements of the drill string. Provided on the lower axial end of the sub 30 is a spring retainer 38 (FIG. 1A) on which is mounted a spring 40, the lower end of which abuts against the upper end of the survey instrument 20 disposed within the instrument barrel 12. The spring 40 serves as a suitable rebound cushion to provide some measure of shock-absorbing capability for the instrumentation within the instrument 20.

Disposed at the lower axial end of the instrument 20 is a T-slot 42 (FIGS. 1D and 5). The T-slot 42 is adapted to receive a T-shaped lug member 44 (FIGS. 1D and 6) which is provided at the upper axial end of a spring retainer assembly 46. The spring retainer 46 receives a spring 48, the opposite end of which is threadedly connected to the upper axial end of an adapter sub 50. External threads 52 are disposed on the adapter sub 50 adjacent the attachment of the spring 48 thereto, which threads 52 are threadedly engageable with the lower internal threads 18 provided on the interior of the barrel 12 to define means on the adapter for engaging the adaptor 50 with the barrel 12. A circumferentially extending shoulder 54 is provided on the sub 50. A fluid-tight engagement is insured by the disposition of an O-ring 56 in a circumferentially extending groove 58 provided on the sub 50.

The T-lug 44 is insertable in a substantially radial manner into the enlarged portion of the T-slot 42 when the lower axial end of the instrument assembly 20 is not yet fully disposed within the instrument barrel 12. With the engagement of the T-lug 44 into the T-slot 42 it may be appreciated that axial connection is effected between the instrument assembly 20 and the sub 50. However, it is also appreciated that no alignment function whatsoever is performed by the insertion of the lug 44 into the slot 42 since the elongated neck portion of the lug 44 is freely rotatable with respect to the slot disposed in the lower end of the barrel. Further, threadedly engaging the threads 18 and 52 until an abutting relationship is defined between the lower axial end of the barrel 12 and the shoulder 54 provided in the sub 50 in no way guarantees an alignment of the barrel 18 and the sub 50. It may, therefore, be appreciated that no adjustability in the sense of orientable alignment between members is provided by the T-elements between the spring retainer 46 and the lower end of the assembly 20. Therefore, when in the fully threaded condition between the sub 50 and the barrel 12, there is no predicability of alignment between the sub 50 and the radially projecting reference line 26 provided on the interior of the instrument 20. It is also appreciated that the spring 48 provides a lower rebound cushion, again to absorb shocks occasioned by the lowering of the apparatus 10 into the running string.

Figure 1E:
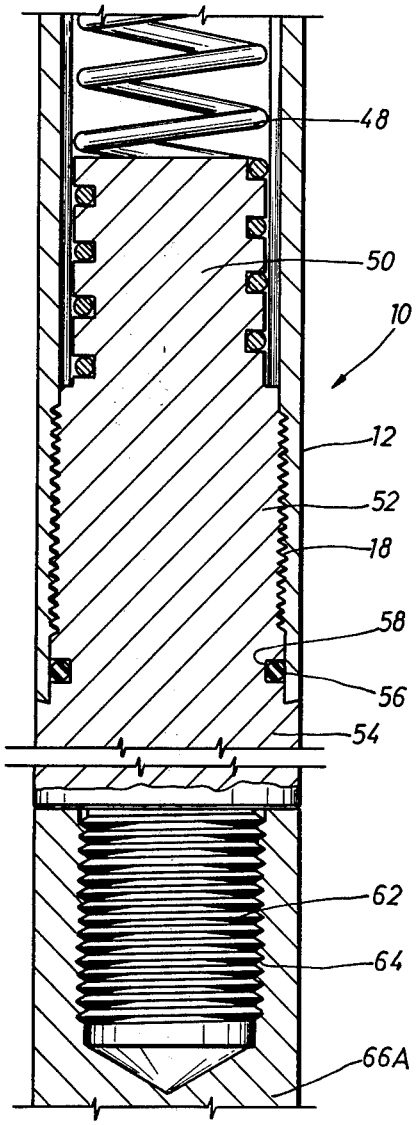

The lower end of the sub 50 (FIG. 1E) is provided with a male member having external threads 62 which are threadedly received by internal threads 64 provided on at least one non-magnetic spacer element 66. The spacers, similar to those described but not shown in connection with the upper axial end of the instrument barrel 12, are fabricated of some non-magnetic material, as aluminum k-monel, or stainless steel. The non-magnetic spacers are used above and below both the instrument 20 and its housing 12 to magnetically isolate the instrument 12 axially above and below. Any predetermined number of spacers 66 may be provided consistent with the particular application in which the apparatus 10 is utilized. Two such spacers 66A and 66B are shown in FIGS. 1E and 1F. Depending upon the number of non-magnetic spacers threaded into the apparatus 10, it may be seen that there is no predictable alignment between a point on the lower axial end of the lowermost spacer and the reference indicator line 26.

The lowermost spacer 66 (FIG. 1F) provides an axially projecting male member having external threads 67 thereon, the threads 67 being adapted to be received by internal threads 68 on the upper axial end of a radially adjustable torque transmitting element, or torque sub 69. As shown in FIGS. 1G and 1H, the torque sub 69 has a first female member, or tubular extension 70, having an array of grooves, or notches, 71 disposed therein (FIG. 8). The grooves 71 are spaced, peak-to-peak, a predetermined angular distance, (for example, six degrees, from each other). The torque sub 69 has a second, male member 72 having a predetermined number N of sets, or arrays, of splines or ridges 74 disposed thereon (FIGS. 1G, 7 and 8). Each set or array of splines or ridges 74 has a predetermined number of individual splines or ridges 76 therein. In the embodiment shown in FIG. 1G, there are six arrays (N=6) of splines or ridges disposed about the exterior surface of the lower axial end of the second, male member 72 of the torque sub 69. Each array of ridges contains 60 individual ridges, with each individual ridge within each array thereof being spaced peak-to-peak from the next-circumferentially adjacent ridge by an angular distance equal to the angular distance between grooves 71 in the female member 70, or six degrees (FIG. 7). It is observed that the total number of arrays N of ridges multiplied by the number of ridges per array is equal to 360. Yet further, as best seen in FIG. 7 and suggested diagrammatically in FIG. 1G, a given location on a ridge in a given array is displaced or offset a predetermined angular distance (one degree in FIG. 7) from the corresponding point on the corresponding ridge in the next axially lower array of ridges. As is made clearer herein, the arrays of ridges and the defined spacings therebetween permits adjacent first (female) and second (male) members 70 and 72, respectively, of the torque sub 69 to be engaged one with the other in a torque-transmitting relationship, yet with a high degree of adjustability with regard to the angular orientation of one member with respect to the other.

Each set of splines 74 is axially spaced apart a predetermined distance 78, as indicated by a relieved portion machined into the projecting male member 72 lower axial end of the torque sub 69. Axially below the lowermost set 74F of ridges a predetermined number of collars 80 are machined into the second, male member 72. The collars 80 exhibit a greater diametrical dimension than the corresponding grooves 82 defined therebetween.

The first, female member, or tubular extension 70 of the torque sub 69 (having the grooves 71 therein) defines an elongated cavity of sufficient dimension to receive substantially the full axial length of the male member 72 of the torque sub 69 (having the splines 76 and collars 80 thereon). A radial port 89 is provided in the tubular extension 70 to receive a radially extending set screw 90, the set screw 90 being received with a selected one of the grooves 82 defined between adjacent collars 80 on the lowermost axial end of the sub 72. As is discussed more fully herein, the set screw 90 acts to secure a mule shoe element 86 in a locked relationship once the desired angular relationship and alignment of the mule shoe with the reference line 26 is obtained. A projecting threaded member 67' disposed on the lower end of the tubular extension 70 is adapted to be received by a threaded portion 68' provided in the upper axial end of the mule shoe assembly 86. Alternatively, it is within the contemplation of this invention to provide a mule shoe 86 having an axially extending portion having grooves (similar to the grooves 71) therein, so that the extending portion of the mule shoe is the functional equivalent of the female member 70 of the torque transmitting sub 69. However, in the preferred embodiment, the torque transmitting element 69 comprising first and second members 70 and 72 as described above is disposed immediately below the lowermost spacer 66B and above the mule shoe assemble 86. Of course, the torque transmitting element 69 may be disposed intermediate the spacers 66A and 66B, if desired.

The lower axial end of the mule shoe assembly 86 defines a diametrically reduced portion, or stringer, 94 terminating in a truncated cone 96. Attached to the stinger 94, as by radially projecting pins 98, is a mule shoe sleeve 100. As is conventional in the art, the mule shoe sleeve 100 includes an axially extending slot 102 communicating with a camming surface 104. A suitable mule shoe arrangement usable in connection with the bottom hole survey apparatus of this invention is that disclosed and claimed in a co-pending application of S. P. Nelson, Ser. No. 812,062, filed July 1, 1977, now U.S. Pat. No. 4,094,360 and assigned to the assignee of the present invention.

In order to provide an accurate indication of the orientation of the downhole member (as a deflectable drilling element) with respect to a predetermined datum, it is necessary that the instrument provided within the barrel 12 (and, in particular, the indicator reference line 26 therewithin) be placed in alignment with that downhole member. This is usually accomplished by the reception of a key (not shown) within the slot 102 of the mule shoe sleeve 100. The key (not shown) is aligned with the member (the deflectable drilling element) in a known relationship. The key extends radially inwardly into the interior bore of the running string. When the bottom hole survey apparatus 10 is lowered within the bore of the running string such that the key (not shown) is received within the slot 102, the instrument 20 may provide a pictorial representation of the orientation of the deflectable drilling element with respect to the predetermined datum. Thus, it is of vital importance that before the assembly 20 be lowered into the bore of the running string, the mule shoe slot 102 be aligned in a predetermined known relationship with the indicator reference line 26.

To insure alignment between the indicator reference line 26 and the slot 102 of the mule shoe sleeve, a pair of clip-on peep sights 106A and 106B (FIGS. 3 and 9, respectively) are utilized. Each clip-on sight 106 includes a resilient bracket 108 having an upstanding post 110 thereon. A peep hole 112 is disposed through each of the posts 110. An inwardly projecting lug 114 is disposed beneath the inner surface of the resilient mounting bracket 108.

Directing attention again to FIG. 3, the peep sight 106A is mounted such that the lug 114A thereon is received within the alignment keyway 28 provided on the exterior surface of the instrument barrel 12. It will be recalled that the keyway 28 is disposed such that a projection of the radial indicator line 26 bisects the keyway 28. With the sight 106A in place, it is observed that an axis 116A through the post 110A and peep hole 112A of the sight 106A is coincident with the projection of the indicator line 26 such that a sightline along reference arrow 120A (shown in the developed view of FIG. 4) is perpendicular to the projection of the radial indicator line 26.

With reference to FIG. 9, the lug 114B on the second sight 106B is disposable within the slot 102 on the mule shoe 100 such that the axis 116B of the post 110B bisects the circumferential dimension of the slot 102. As viewed in the developed view of FIG. 10, a sightline along reference arrow 120B, taken through the peep hole 112B on the post 110B, when brought into axial alignment with the sightline along the reference arrow 120A through the peep hole 112A on the sight 106A, insures axial alignment between the slot 102 in the mule shoe sleeve 100 and the indicator line 26 within the instrument 20. With the relationship between the reference line 26 and the slot 102 determined by the axial coincidence of the sightlines, the appropriate array 74 of ridges provided on the male member 72 of the torque sub 69 is received within the set of grooves 71 disposed on the disposed on the interior of the female tubular extension 70 of the torque sub 69 such that a maximum deviation of one-half degree between the sight lines is generated. The lock screw 90 may then be engaged within the appropriate groove corresponding slot 82 to lock the mule shoe 86 in position so as to maintain alignment between the slot 102 and the reference line 26.

As may be appreciated by those skilled in the art, the overall goal of the apparatus 10 is to orient the mule shoe slot 102 with respect to the reference line 26 in the instrument 20. If the embodiment of the invention shown in FIGS. 1G and 1H is used, (i.e., the torque sub 69 is provided between the lower spacer 66B and the mule shoe 86), securing the mule shoe 86 and the torque sub 69 in the precise angular relationship necessary to orient the mule shoe slot 102 with the reference line 26 may not be possible due to the necessity of registration between a selected one array 74 of ridges 76 on the male member 72 (attached to the spacer 66B) and the grooves 71 on the interior of the female member 70 (attached to the mule shoe 86). However, due to the interrelationship between the number N of arrays 74 of ridges and the number of individual ridges 76 in each array (as defined above), the slot 102 of the mule shoe assembly 86 is never more than one-half degree from a precise orientation with the reference line 26. Use of the torque sub 69 shown in FIG. 1, therefore, is advantageous in that an arrangement is provided whereby torque applied to the mule shoe 86 is effectively transmitted to the remainder of the tool, while at the same time permitting the mule shoe slot 102 to be aligned within an acceptable tolerance (one-half degree) of exact registration with the reference line 26. Of course, once the mule shoe 86 is oriented within the predetermined tolerance of precise alignment (one-half degree in the embodiment shown in FIG. 1), the set screw 90 is engaged into the appropriate groove 82 in the torque sub 69.

Alternatively, in an embodiment of the invention not illustrated in the drawings, the torque sub 69 may be eliminated. In that case, the lowermost spacer 66B is directly threaded to the mule shoe assembly 86 by a conventional threaded box arrangement. In this way, the mule shoe assembly 86 may be precisely oriented with reference line 26. Once the proper degree of threaded engagement between the spacer and the mule shoe is provided (to precisely orient the mule shoe slot with the reference line 26), a set screw provided for the purpose may be used to lock the mule shoe assembly 86 to the spacer 66. It may be convenient to think of the embodiment shown in FIG. 1 as being "quantized" in the sense that only discrete angular orientations (albeit within one-half degree) between the mule shoe slot 102 and the reference line 26 may be effected due to the requirement that the ridges 76 register with and be received by the grooves 71. On the other hand, the second embodiment discussed immediately above may be viewed as "continuous", in that any angular orientation may be defined between the spacer 66 and the mule shoe 86 and secured by suitable locking means.

As a further feature, as shown in FIG. 11, graduated scale indicia 122 may be provided on the adjacent surfaces between the members 70 and 72 of the torque sub 69. If the embodiment of the invention shown in FIG. 1 is used, i.e., a torque sub 69 is provided, the scale indicia 122 is provided adjacent the upper axial end of the female member 70 and the portion of the surface of the male member 72 which is next-adjacent to the upper edge of the extension 70 (FIG. 11). If the alternative embodiment mentioned above is used, the indicia are provided on the adjacent surfaces where the mule shoe is connected to the lower spacer.

In either case, the purpose of the indicia 122 is to permit an operator to account for local deviations between magnetic and true north. As is well known, depending upon the locality, a predetermined angular deviation between the direction true north and the direction magnetic north is defined. This deviation must be factored into the data generated by the survey apparatus. However, with the indicia 122, the operator may accomodate the deviation between true north and magnetic north before the apparatus is lowered. Once the slot 102 and the reference line 26 are aligned, in the manner discussed above, the operator may use the indicia 122 to accomodate the deviation between the north directions so that data generated by the survey will reflect the deviation. With the deviation accomodated, the appropriate set of ridges 74 is inserted to the grooves 71 and the set screw 90 is locked (if the embodiment of FIG. 1 is used), or the set screw used to secure the mule shoe with the lower spacer is locked (if the alternate embodiment discussed above is used).

It may thus be appreciated that this invention defines an apparatus whereby alignment of a mule shoe slot with a radially extending indicator reference line disposed in an instrument for a bottom hole survey may be effected. Advantages occasioned by the combination hereinbefore described includes the ability to completely and securely assemble the survey apparatus before the mule shoe is oriented. Accordingly, after the tool is entirely made up, the alignment of the radial indicator reference line 26 with the mule shoe slot 102 may be effected. Further, flexibility is provided due to the fact that any predetermined number of spacers may be interposed between the lower end of the barrel 12 and the mule shoe and yet accurate (to within one-half degree) alignment of the indicator reference line with the slot in the mule shoe may be provided. It is especially noted that no alignment adjustability is imparted by the T-slot and T-lug connection between the lower end of the instrument and the upper end of the spring retainer 46. It is further emphasized that no adjustable locking means is provided at this loaction.

Having described preferred embodiments of this invention, those skilled in the art may effect numerous modifications thereto in view of the teachings herein and yet remain within the contemplation of this invention as defined in the appended claims.

What is claimed is:

1. A bottom hole survey apparatus comprising:

a survey instrument having a reference line therein;

an instrument barrel adapted to receive said instrument therein, said reference line being disposed in a predetermined angular location within said barrel;

means disposed on the exterior of said barrel for receiving a visual sighting element thereon, said means being disposed in a predetermined relationship with respect to said reference line;

at least one spacer element connected to said barrel;

a mule shoe having a slot therein adapted to be connected to said spacer, said mule shoe being adaptable to receive a second visual sighting element within said slot thereof; and, means for adjusting said mule shoe with respect to said spacer to dispose said slot in said mule shoe in a predetermined alignment with said reference line when said first and second visual sighting elements are visually aligned; and, locking means disposed adjacent to said mule shoe and accessible from the exterior of the apparatus for locking said mule shoe in position so as to maintain alignment between said slot and said reference line.

2. The bottom whole survey apparatus according to claim 1 wherein the axially lower end of said instrument has a T-shaped slot therein, and further comprising:

an adapter having a T-shaped head thereon connected to said spacer, said T-head on said adapter being engagable with said T-slot at the lower end of said instrument; and, means on said adapter for engaging said adapter with said barrel after said T-head is engaged with said T-slot.

3. The bottom hole survey apparatus according to claim 1 wherein said means for adjusting includes a torque transmitting element comprising:

a first member having a predetermined plurality of axially extending grooves disposed circumferentially thereon connected to said mule shoe; and, a second member having a predetermined plurality of arrays of axially extending ridges connected to said spacer, each array having a predetermined plurality of ridges therein, each ridge in each array being angularly spaced from the next-adjacent ridge in the array by a first predetermined angular distance, each ridge within each array being angularly offset from the corresponding ridge in the next axially adjacent array by a second predetermined angular distance.

4. The bottom hole survey apparatus according to claim 3 wherein the number of arrays of ridges multiplied by the number of ridges in each array is equal to 360.

5. The bottom hole survey apparatus according to claim 3 further comprising graduated indicia disposed in next axial adjacency on said spacer and said mule shoe, said mule shoe being angularly adjustable with respect to said spacer by an angular amount indicated by said indicia.

6. A torque transmitting element for the angularly adjustable interconnection of a first and a second member comprising:

a predetermined plurality of axially extending grooves disposed circumferentially on said first member; and, a predetermined plurality of arrays of axially extending ridges disposed circumferentially on said second member, each array having a predetermined plurality of ridges therein, each ridge in each array being angularly spaced from the next-adjacent ridge in the array by a first predetermined angular distance, each ridge within each array being angularly offset from the corresponding ridge in the next axially adjacent array by a second predetermined angular distance.

7. A torque transmitting element of claim 6 wherein the number of ridges in each array multiplied by the number of arrays of ridges equals 360.

8. A torque transmitting element of claim 6 wherein said first angular distance is greater than said second angular distance.

* * * * *

UNITED STATES PATENT AND TRADEMARK OFFICE

CERTIFICATE OF CORRECTION

PATENT NO. : 4,141,153

DATED : February 27, 1979

INVENTOR(S) : Paul M. Nelson

It is certified that error appears in the above-identified patent and that said Letters Patent are hereby corrected as shown below:

Column 3, line 7, "the" should read --to--.

Column 11, line 2, "loaction" should read --location--.

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*